US007819009B2

(12) United States Patent
Borah et al.

(10) Patent No.: US 7,819,009 B2
(45) Date of Patent: Oct. 26, 2010

(54) VIBRATION MONITORING SYSTEM

(76) Inventors: Frederic Borah, 2150 Cayuga Dr., Merrick, NY (US) 11566; Anthony Leib, Jr., 15 Campden La., Commack, NY (US) 11725; George Fkiaras, 34 Vanderwater St., Farmingdale, NY (US) 11735; Ruben F. Lah, 4589 W. Ripple Creek Cir., West Jordan, UT (US) 84088

( * ) Notice: Subject to any disclaimer, the term of this patent is extended or adjusted under 35 U.S.C. 154(b) by 227 days.

(21) Appl. No.: 11/679,593

(22) Filed: Feb. 27, 2007

(65) Prior Publication Data

US 2008/0000298 A1 Jan. 3, 2008

Related U.S. Application Data

(60) Provisional application No. 60/777,621, filed on Feb. 28, 2006.

(51) Int. Cl.
*G01N 19/00* (2006.01)
*B23B 29/00* (2006.01)

(52) U.S. Cl. ..... 73/602; 73/861.18; 82/118

(58) Field of Classification Search ..... 73/602, 73/61 R, 572, 587, 861.18, 861.73; 239/1, 239/8, 61, 71; 82/158, 118
See application file for complete search history.

(56) References Cited

U.S. PATENT DOCUMENTS

| | | | |
|---|---|---|---|
| 176,321 | A | 4/1876 | Kromer |
| 1,656,355 | A | 1/1928 | Huffmann |
| 1,991,621 | A | 2/1935 | Noll |
| 2,064,567 | A | 12/1936 | Riley |
| 2,245,554 | A | 6/1941 | Court |
| 2,317,566 | A | 4/1943 | Utterback |
| 2,403,608 | A | 7/1946 | Payne et al. |
| 2,562,285 | A | 7/1951 | Timmer |
| 2,717,865 | A | 9/1955 | Kimberlin, Jr. et al. |
| 2,734,715 | A | 2/1956 | Knox |
| 2,761,160 | A | 9/1956 | Manning |
| 3,215,399 | A | 11/1965 | McInerney et al. |
| 3,379,623 | A | 4/1968 | Forsyth |
| 3,617,480 | A | 11/1971 | Keel |
| 3,646,947 | A | 3/1972 | Rochelle et al. |
| 3,716,310 | A | 2/1973 | Guenther |
| 3,837,356 | A | 9/1974 | Selep et al. |
| 3,852,047 | A | 12/1974 | Schlinger et al. |

(Continued)

FOREIGN PATENT DOCUMENTS

| | | |
|---|---|---|
| JP | 2000145989 | 5/2001 |

(Continued)

OTHER PUBLICATIONS

Reliable Monitoring for small tools, Albert Trail, Nordman Tool monitoring, May 16, 2006.*

(Continued)

*Primary Examiner*—J M Saint Surin
(74) *Attorney, Agent, or Firm*—Michael Krieger

(57) ABSTRACT

The present invention relates to a vibration monitoring device and methods for using the same. Specifically, the invention relates to a vibration monitoring device which may be utilized throughout a delayed coker unit operation to ascertain whether the cutting tool is boring, cutting or ramping mode.

47 Claims, 6 Drawing Sheets

U.S. PATENT DOCUMENTS 4,125,438 A 11/1978 Kelly et al.
4,174,728 A 11/1979 Usnick et al.
4,253,487 A 3/1981 Worley et al.
4,275,842 A 6/1981 Purton et al.
4,410,398 A 10/1983 Chipman et al.
RE31,439 E 11/1983 Rosensweig
4,492,103 A 1/1985 Naumann
4,531,539 A 7/1985 Jandrasi et al.
4,611,613 A 9/1986 Kaplan
4,626,320 A 12/1986 Alworth et al.
4,666,585 A 5/1987 Figgins et al.
4,726,109 A 2/1988 Malsbury et al.
4,738,399 A 4/1988 Adams
4,771,805 A 9/1988 Maa
4,797,197 A 1/1989 Mallari
4,824,016 A 4/1989 Cody et al.
4,877,488 A 10/1989 Cody et al.
4,923,021 A 5/1990 Courmier et al.
4,929,339 A 5/1990 Elliott, Jr. et al.
4,960,358 A 10/1990 DiGiacomo et al.
4,973,386 A 11/1990 Callegari et al.
4,993,264 A 2/1991 Cody et al.
5,004,152 A 4/1991 Baker et al.
5,022,266 A 6/1991 Cody et al.
5,022,268 A 6/1991 Wolf et al.
5,024,730 A 6/1991 Colvert
5,035,221 A 7/1991 Martin
5,041,207 A 8/1991 Harrington et al.
5,048,876 A 9/1991 Wallskog
5,059,331 A 10/1991 Goyal
5,107,873 A 4/1992 Clinger
5,116,022 A 5/1992 Genreith et al.
5,193,406 A * 3/1993 Wolf et al. ..... 73/865.9
5,221,019 A 6/1993 Pechacek et al.
5,228,525 A 7/1993 Denney et al.
5,228,825 A 7/1993 Fruchtbaum et al.
5,299,841 A 4/1994 Schaefer
5,415,048 A * 5/1995 Diatschenko et al. .... 73/861.04
5,417,811 A 5/1995 Malsbury
H1442 H 6/1995 Edgerton et al.
5,464,035 A 11/1995 Heinecke
5,581,864 A 12/1996 Rabet
5,633,462 A 5/1997 Heaslip et al.
5,652,145 A * 7/1997 Cody et al. ..... 436/34
5,700,116 A * 12/1997 Cobb, Jr. ..... 409/141
5,785,843 A 7/1998 Antalffy et al.
5,800,680 A 9/1998 Guerra
5,816,505 A 10/1998 Tran et al.
5,816,787 A 10/1998 Brinkerhoff
5,876,568 A 3/1999 Kindersley
5,907,491 A 5/1999 Canada et al.
5,927,684 A 7/1999 Marx et al.
5,947,674 A 9/1999 Malsbury et al.
5,974,887 A * 11/1999 Cody et al. ..... 73/602
6,007,068 A 12/1999 Dellacorte
6,039,844 A 3/2000 Malik
6,066,237 A 5/2000 Kindersley
6,113,745 A 9/2000 Maitland et al.
6,117,308 A 9/2000 Ganji
6,223,925 B1 5/2001 Malsbury et al.
6,228,225 B1 5/2001 Meher-Homji
6,254,733 B1 7/2001 Lu et al.
6,264,797 B1 7/2001 Schroeder et al.
6,264,829 B1 7/2001 Antalffy et al.
6,367,843 B1 4/2002 Fetzer
6,539,805 B2 4/2003 Heaslip et al.
6,547,250 B1 4/2003 Noble et al.
6,565,714 B2 5/2003 Lah
6,644,436 B2 11/2003 Hofmann et al.
6,644,567 B1 11/2003 Adams et al.
6,660,131 B2 12/2003 Lah
6,738,697 B2 5/2004 Breed
6,751,852 B2 6/2004 Malsbury et al.
6,843,889 B2 1/2005 Lah
6,926,807 B2 8/2005 Bosi et al.
6,964,727 B2 11/2005 Lah
6,989,081 B2 1/2006 Lah
7,033,460 B2 4/2006 Lah
7,037,408 B2 5/2006 Wilborn et al.
7,115,190 B2 10/2006 Lah
7,117,959 B2 * 10/2006 Lah ..... 175/67
7,316,762 B2 1/2008 Lah
7,340,985 B2 * 3/2008 Claesson et al. ..... 82/163
7,473,337 B2 * 1/2009 Lah ..... 202/239
2002/0134658 A1 9/2002 Lah
2002/0157897 A1 10/2002 Hofmann et al.
2002/0166862 A1 11/2002 Malsbury et al.
2002/0170814 A1 11/2002 Lah
2003/0047153 A1 3/2003 Kubel et al.
2003/0089589 A1 5/2003 Malsbury
2003/0127314 A1 7/2003 Bell et al.
2003/0159737 A1 8/2003 Stares
2003/0185718 A1 10/2003 Sellakumar
2004/0118746 A1 6/2004 Wilborn et al.
2004/0154913 A1 8/2004 Lah

FOREIGN PATENT DOCUMENTS

RU 2043604 10/1995
RU 2163359 8/1999
SU 558524 11/1973
SU 959413 12/1980
WO 200015985 3/2000

OTHER PUBLICATIONS

Norm Lieberman, "Coke Drum Foam-Overs Causes & Cures," http://www.coking.com/Foamover.htm, (Aug. 1, 2007).
U.S. Appl. No. 10/731,874, Non-Final Rejection issued Feb. 23, 2005 by the United States Patent and Trademark Office. pp. 1-7.
U.S. Appl. No. 10/731,874, Final Rejection issued Jun. 28, 2005 by the United States Patent and Trademark Office. pp. 1-7.
U.S. Appl. No. 10/731,874, Examiner's search and stategy results issued Sep. 26, 2005, 1 page.
U.S. Appl. No. 10/731,874, Notice of Allowance of Fees Due, Issue Information, Index of Claims and Search information issued Sep. 29, 2005 by the United States Patent and Trademark Office; 7 pages.
U.S. Appl. No. 10/731;874, Notice of Allowance of Fees Dues, List of References, Issue Information, Search information and indes of claims issued Jan. 18, 2006 by the United States Patent and Trademark Office;10 pages.
U.S. Appl. No. 10/731,874, Non-Final Rejection issued Oct. 13, 2006 by the United States Patent and Trademark Office; 22 pages.
U.S. Appl. No. 10/731,874, Non-Final Rejection issued Apr. 6, 2007 by the United States Patent and Trademark Office;14 pages.
U.S. Appl. No. 10/731,874, Requirement for Restriction/Election, List of Reference and index of claims issued Sep. 6, 2007 by the United States Patent and Trademark Office;20 pages.
U.S. Appl. No. 10/731,874, Examiner's search strategy and results issued Dec. 5, 2007, 1 page.
U.S. Appl. No. 10/731,874, Non-Final Rejection issued Dec. 11, 2007 by the United States Patent and Trademark Office; 22 pages.
U.S. Appl. No. 10/997,834, Examiner's search strategy and results issued Jun. 22, 2005; 5 pages.
U.S. Appl. No. 10/997,834, Non-Final Rejection issued Jul. 6, 2005 by the United States Patent and Trademark Office; 44 pages.
U.S. Appl. No. 10/997,834, Examiner's search strategy and results issued Sep. 26, 2005;1 page.
U.S. Appl. No. 10/997,834, Notice of Allowance and Fees, Issue Information, Index of Claims and search information issued Sep. 29, 2005 by the United States Patent and Trademark Office; 8 pages.
U.S. Appl. No. 10/411,849, Examiner's search strategy and results issued Aug. 4, 2005; 5 pages.
U.S. Appl. No. 10/411,849, Non-Final Rejection issued Aug. 9, 2005 by the United States Patent and Trademark Office; 8 pages.

U.S. Appl. No. 10/411,849, Non-Final Rejection issued Feb. 8, 2006 by the United States Patent and Trademark Office; 7 pages.
U.S. Appl. No. 10/411,849, Examiner's search strategy and results issued Jul. 18, 2006; 1 page.
U.S. Appl. No. 10/411,849, Notice of Allowance and Fees Due, Examiner Interview Summary Record, Issue Information, Index of Claims, Search Information and Bibliographis Data Sheet issued Jul. 24, 2006 by the United States Patent and Trademark Office; 14 pages.
U.S. Appl. No. 10/997,234, Examiner's search strategy and results issued Mar. 14, 2006; 3 pages.
U.S. Appl. No. 10/997,234, Examiner's search strategy and results issued Mar. 14, 2006; 3 pages.
U.S. Appl. No. 10/997,234, Examiner's search strategy and results issued Aug. 4, 2006; 1 page.
U.S. Appl. No. 10/997,234, Notice of Allowance and Fees Due, Issue Information, Bibliographic Data Sheet, Index of Claims and Search Information issued Aug. 10, 2006 by the United States Patent and Trademark Office, 8 pages.
U.S. Appl. No. 10/412,628, Non-Final Rejection issued Feb. 16, 2007 by the United States Patent and Trademark Office; 17 pages.
U.S. Appl. No. 10/412,628, Notice of Allowance and Fees Due, Bibliographic Data Sheet, Index of Claims, Search Information and Issue Information issued Aug. 24, 2007 by the United States Patent and Trademark Office; 11 pages.
U.S. Appl. No. 10/873,022, Non-Final Rejection issued Jul. 7, 2005 by the United States Patent and Trademark Office, 12 pages.
U.S. Appl. No. 10/873,022, Notice of Allowance and Fees Due, Specification and Issue Information issued Jan. 4, 2006 by the United States Patent and Trademark Office, 9 pages.
U.S. Appl. No. 10/274,280, Examiner's search strategy and results issued Mar. 14, 2004; 2 pages.
U.S. Appl. No. 10/274,280, Non-Final Rejection issued Mar. 25, 2004 by the United States Patent and Trademark Office; 10 pages.
U.S. Appl. No. 10/274,280, Notice of Allowance and Fees Due, Issue Information and Bibliographic Data Sheet issued Oct. 5, 2004 by the United States Patent and Trademark Office; 8 pages.
U.S. Appl. No. 10/442,673, Examiner's search strategy and results issued Aug. 26, 2004, 2 pages.
U.S. Appl. No. 10/442,673, Non-Final Rejection issued Sep. 1, 2004 by the United States Patent and Trademark Office; 10 pages.
U.S. Appl. No. 10/442,673, Final Rejection issued Feb. 23, 2005 by the United States Patent and Trademark Office; 6 pages.
U.S. Appl. No. 10/442,673, Notice of Allowance and Fees Due, Amendment After Final, Issue Information, Index of Claims and Search Information issued Apr. 20, 2005 by the United States Patent and Trademark Office; 10 pages.

* cited by examiner

VIBRATION MONITORING SYSTEM

RELATED APPLICATIONS

This application claims priority to U.S. Provisional Patent Application Ser. No. 60/777,621, filed Feb. 28, 2006, entitled "Vibration Monitoring System."

BACKGROUND

1. Field of the Invention

The present invention relates to vibration monitoring devices and methods for using the same. Specifically, the present invention relates to determining the direction of water flow of a coker water drill in a coker drum and to noninvasive signature recognition systems using accelerometer and mathematical algorithms for signature detection.

2. Background

Petroleum refining operations in which crude oil is processed frequently produce residual oils. Many oil refineries recover valuable products from the heavy residual hydrocarbons. Residual oil, when processed in a delayed coker is heated in a furnace to a temperature sufficient to cause destructive distillation in which a substantial portion of the residual oil is converted, or "cracked" to usable hydrocarbon products and the remainder yields petroleum coke, a material composed mostly of carbon Generally, the delayed coking process involves heating the heavy hydrocarbon feed from a fractionation unit, then pumping the heated heavy feed into a large steel vessel commonly known as a coke drum. The unvaporized portion of the heated heavy feed settles out in the coke drum, where the combined effect of retention time and temperature causes the formation of coke. Vapors from the top of the coke vessel are returned to the base of the fractionation unit for further processing into desired light hydrocarbon products. Normal operating pressures in coke drums typically range from twenty-five to fifty p.s.i, and the feed input temperature may vary between 800° F. and 1000° F.

The structural size and shape of the coke drum varies considerably from one installation to another. Coke drums are generally large, upright, cylindrical, metal vessel ninety to one-hundred feet in height, and twenty to thirty feet in diameter. Coke drums have a top head and a bottom portion fitted with a bottom head. Coke drums are usually present in pairs so that they can be operated alternately. Coke settles out and accumulates in a vessel until it is filled, at which time the heated feed is switched to the alternate empty coke drum. While one coke drum is being filled with heated residual oil, the other vessel is being cooled and purged of coke.

Coke removal, also known as decoking, begins with a quench step in which steam and then water are introduced into the coke filled vessel to complete the recovery of volatile, light hydrocarbons and to cool the mass of coke. After a coke drum has been filled, stripped and then quenched so that the coke is in a solid state and the temperature is reduced to a reasonable level, quench water is drained from the drum through piping to allow for safe unheading of the drum. The drum is then vented to atmospheric pressure when the bottom opening is unheaded, to permit removing coke. Once the unheading is complete, the coke in the drum is cut out of the drum by high pressure water jets.

Decoking is accomplished at most plants using a hydraulic system comprised of a drill stem and drill bit that direct high pressure water into the coke bed. A rotating combination drill bit, referred to as the cutting tool, is typically about twenty-two inches in diameter with several nozzles, and is mounted on the lower end of a long hollow drill stem about seven inches in diameter. The drill bit is lowered into the vessel, on the drill stem, through a flanged opening at the top of the vessel. A "bore hole" is drilled through the coke using the nozzles, which eject high pressure water at an angle between approximately zero and twenty-three degrees up from vertical. This creates a pilot bore hole, about two to three feet in diameter, for the coke to fall through.

After the initial bore hole is complete, the drill bit is then mechanically switched to at least two horizontal nozzles in preparation for cutting the "cut" hole, which extends to the full drum diameter. In the cutting mode the nozzles shoot jets of water horizontally outwards, rotating slowly with the drill rod, and those jets cut the coke into pieces, which fall out the open bottom of the vessel, into a chute that directs the coke to a receiving area. In all employed systems the drill rod is then withdrawn out the flanged opening at the top of the vessel. Finally, the top and bottom of the vessel are closed by replacing the head units, flanges or other closure devices employed on the vessel unit. The vessel is then clean and ready for the next filling cycle with the heavy hydrocarbon feed.

In some coke-cutting system, after the boring hole is made, the drill stem must be removed from the coke drum and reset to the cutting mode. This takes time, is inconvenient and is potentially hazardous. In other systems the modes are automatically switched. Automatic switching within the coke drum oftentimes results in drill stem clogging, which still requires the drill stem to be removed for cleaning prior to completing the coke-cutting process. Often, in automatic switching systems, it is difficult to determine whether or not the drill stem is in cutting or boring mode, because the entire change takes place within the drum. Mistakes in identifying whether the high pressure water is cutting or boring lead to serious accidents. Thus, coke-cutting efficiency is compromised because the switching operator does not know whether or not the cutting process is complete or simply clogged.

If the hydro-cutting system is not shut off before the drill stem is raised out of the top drum opening, operators are exposed to the high-pressure water jet and serious injuries including dismemberment occur. Thus, operators are exposed to significant safety hazards from exposure to high pressure water jets in close proximity to the vessel being decoked, to manually change the cutting head from the boring to cutting mode or when an operator has not accurately been able to access whether the head is cutting, boring or off.

SUMMARY

The present invention relates to a system for remotely monitoring the status of a cutting tool during delayed decoker unit operation. In particular, the present invention relates to systems for allowing operators involved in removing solid carbonaceous residue, referred to as "coke," from large cylindrical vessels called coke drums to determine the status of the decoking operation from a remote location.

Other embodiments relate to continuous monitoring and detection of reduced material thickness in elbows and pipes which are carrying high temperature and/or high pressure fluids or gases.

In other embodiments the monitoring system may be utilized to measure bearing wear. In a preferred embodiment bearing deterioration can be detected before failure on critical rotating machinery either not being monitored or being periodically monitored.

In other embodiments the monitoring system may be used for detecting coke clogging the furnace pipes which are heating the petroleum before going into the coke drum.

In other embodiments the monitoring system may be used to monitor/detect the movement of fluids/gas in pipes.

Preferred embodiments relate to systems, which utilize vibration monitoring systems to receive useful information regarding the decoking operation. Other embodiments relate to the system, which utilize acoustical monitoring systems to receiving useful information regarding the decoking operation. Other embodiments relate to systems, which utilize temperature monitoring systems to receiving useful information regarding the decoking operations. Other embodiments relate to systems which utilize pressure monitoring systems to receive useful information regarding the decoking operation.

Preferred embodiments of the invention relate to a system that allows an operator to remotely detect the status of a cutting tool while cutting coke within a coke drum, and to remotely detect when the tool has switched between the "boring" and the "cutting" modes, while cutting coke within a coke drum reliably, and without raising the drill bit out of the coke drum for mechanical alteration or inspection.

Preferred embodiments provide a visual display which indicates the status of the decoking operation. In some embodiments, a visual display allows the operator to determine what mode the cutting tool is presently in.

In some embodiments, vibrational data is utilized to provide information regarding mechanical status of the cutting tool of a delayed de-coker unit. Preferred embodiments utilize a vibration monitoring device comprising an accelerometer. In preferred embodiments the vibration monitoring device may be attached to one or more locations in the delayed decoker unit.

In some embodiments, some of these measurements are relayed by a wireless device to a network access point and/or to a repeater which relays the signal from the wireless device to network access points. In other embodiments the data generated by the vibration monitoring devices is hardwired to a computer system, without the use of a wireless device. In some embodiments the data received at the network access point is relayed to a computer system where the vibration data may be monitored and utilized.

In some embodiments the data received from the vibration monitoring devices is converted by software applications to a useable form. In preferred embodiments data is routed to a Fast Fourier Transform ("FFT"), which converts the data into an FFT fingerprint, which may be utilized as a signature associated with the different modes of operation during a decoking operation.

Some embodiments comprise a vibration monitoring device, comprising: an accelerometer, wherein the accelerometer provides an output signal; at least one network access point which receives the output from the vibration monitoring device; software for converting the raw data into a useable wave form; and a display apparatus which informs an operator of the status of the cutting tool in a coke drum.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
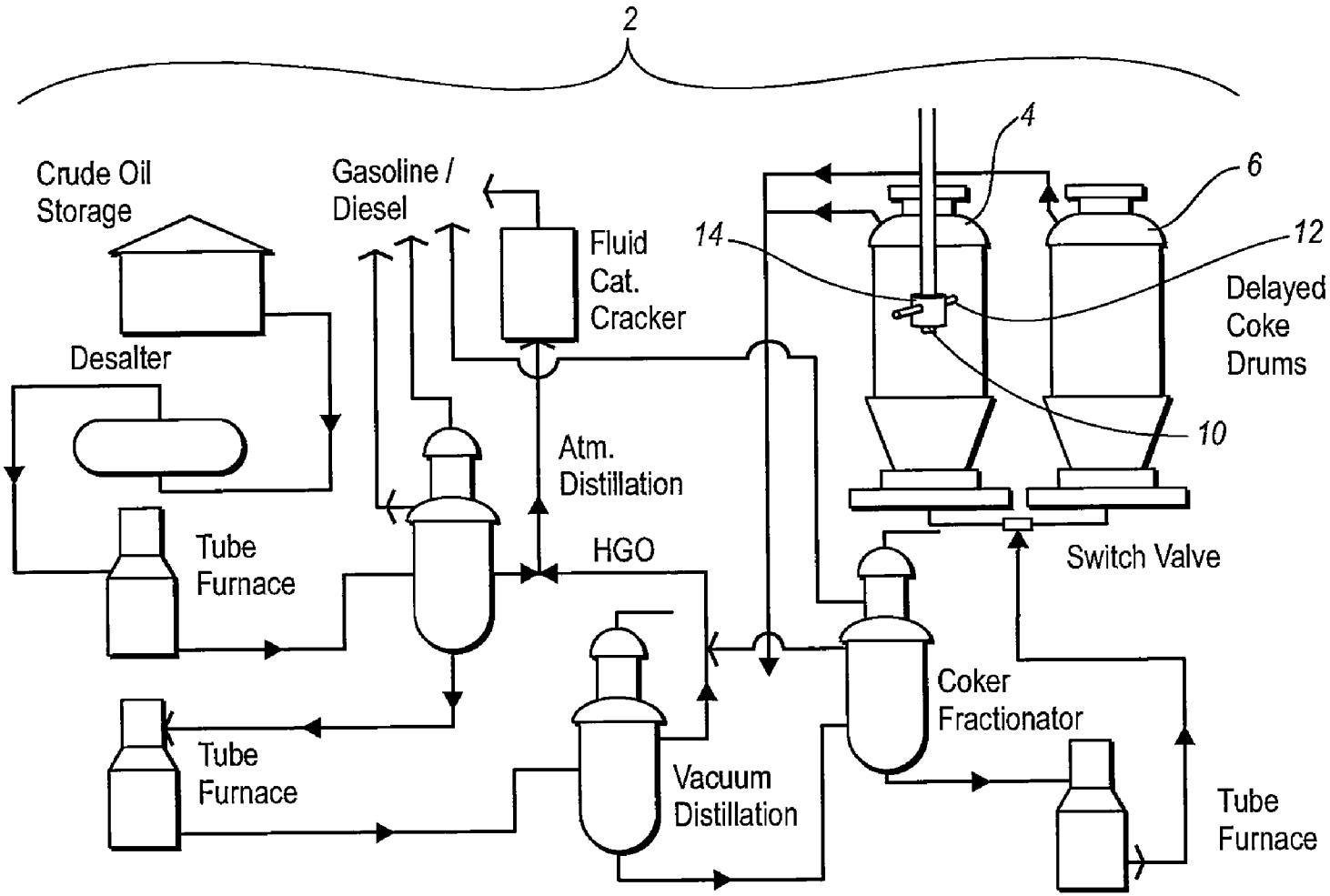
FIG. 1 illustrates, a basic refinery flow diagram.

It will be readily understood that the components of the present invention, as generally described and illustrated in the figures herein, could be arranged and designed in a wide variety of different configurations. Thus, the following more detailed description of the embodiments of the system, device, and method of the present invention, as represented in FIGS. 1-6, is not intended to limit the scope of the invention, as claimed, but is merely representative of some of the embodiments of the invention.

Embodiments of the invention will be best understood by reference to the drawings wherein like parts are designated by like numerals throughout. Although reference to the drawings and a corresponding discussion follow below, the following more detailed description is divided into sections. The first section pertains to and sets forth a general discussion of the delayed coking process. The second section pertains to and sets forth the vibration monitoring system that may be utilized in the delayed coking process, as well as the various methods for utilizing the system within a delayed coking or other similar environment. It is noted that these sections are not intended to be limiting in any way, but are simply provided as convenience to the reader.

1. General Discussion on the Delayed Coking Process

In the typical delayed coking process, high boiling petroleum residues are fed to one or more coke drums where they are thermally cracked into light products and a solid residue—petroleum coke. The coke drums are typically large cylindrical vessels having a top head and a conical bottom portion fitted with a bottom head. The fundamental goal of coking is the thermal cracking of very high boiling point petroleum residues into lighter fuel fractions. Coke is a byproduct of the process. Delayed coking is an endothermic reaction with a furnace supplying the necessary heat to complete the coking reaction in a drum. The exact mechanism is very complex, and out of all the reactions that occur, only three distinct steps have been isolated: 1) partial vaporization and mild coking of the feed as it passes through the furnace; 2) cracking of the vapor as it passes through the coke drum; and 3) cracking and polymerization of the heavy liquid trapped in the drum until it is converted to vapor and coke. The process is extremely temperature-sensitive with the varying temperatures producing varying types of coke. For example, if the temperature is too low, the coking reaction does not proceed far enough and pitch or soft coke formation occurs. If the temperature is too high, the coke formed generally is very hard and difficult to remove from the drum with hydraulic decoking equipment. Higher temperatures also increase the risk of coking in the furnace tubes or the transfer line. As stated, delayed coking is a thermal cracking process used in petroleum refineries to upgrade and convert petroleum residuum into liquid and gas product streams leaving behind a solid concentrated carbon material, or coke. A furnace is used in the process to reach thermal cracking temperatures, which range upwards of 1,000° F. With short residence time in the furnace, coking of the feed material is thereby "delayed" until it reaches large coking drums downstream of the heater. In normal operations, there are two coke drums so that when one is being filled, the other may be purged of the manufactured coke.

In a typical petroleum refinery process, several different physical structures of petroleum coke may be produced. These are namely, shot coke, sponge coke, and/or needle coke (hereinafter collectively referred to as "coke"), and are each distinguished by their physical structures and chemical properties. These physical structures and chemical properties also serve to determine the end use of the material. Several uses are available for manufactured coke, some of which include fuel for burning, the ability to be calcined for use in the aluminum, chemical, or steel industries, or the ability to be gasified to produce steam, electricity, or gas feedstock for the petrochemicals industry.

To produce the coke, a delayed coker feed originates from the crude oil supplied to the refinery and travels through a series of process members and finally empties into one of the coke drums used to manufacture coke. A basic refinery flow diagram is presented as FIG. 1, with two coke drums shown. The delayed coking process typically comprises a batch-continuous process, which means that the process is ongoing or continuous as the feed stream coming from the furnace alternates filling between the two or more coke drums. As mentioned, while one drum is on-line filling up with coke, the other is being stripped, cooled, decoked, and prepared to receive another batch. In the past, this has proven to be an extremely time and labor intensive process, with each batch in the batch-continuous process taking approximately 12-20 hours to complete. In essence, hot oil, or resid as it is commonly referred to, from the tube furnace is fed into one of the coke drums in the system. The oil is extremely hot and produces hot vapors that condense on the colder walls of the coke drum. As the drum is being filled, a large amount of liquid runs down the sides of the drum into a boiling turbulent pool at the bottom. As this process continues, the hot resid and the condensing vapors cause the coke drum walls to heat. This naturally in turn, causes the resid to produce less and less of the condensing vapors, which ultimately causes the liquid at the bottom of the coke drum to start to heat up to coking temperatures. After some time, a main channel is formed in the coke drum, and as time goes on, the liquid above the accumulated coke decreases and the liquid turns to a more viscous type tar. This tar keeps trying to run back down the main channel which can coke at the top, thus causing the channel to branch. This process progresses up through the coke drum until the drum is full, wherein the liquid pools slowly turn to solid coke. When the first coke drum is full, the hot oil feed is switched to the second coke drum, and the first coke drum is isolated, steamed to remove residual hydrocarbons, cooled by filling with water, opened, and then decoked. This cyclical process is repeated over and over again throughout the manufacture of coke. The decoking process is the process used to remove the coke from the drum upon completion of the coking process. Due to the shape of the coke drum, coke accumulates in the area near and attaches to the flanges or other members used to close off the opening of the coke drum during the manufacturing process. To decoke the drum, the flanges or members must first be removed or relocated. In the case of a flanged system, once full, the coke drum is vented to atmospheric pressure and the top flange (typically a 4-foot diameter flange) is unbolted and removed to enable placement of a hydraulic coke cutting apparatus. After the cooling water is drained from the vessel, the bottom flange (typically a 7-foot-diameter flange) is unbolted and removed. This process is commonly known as "de-heading" because it removes or breaks free the head of coke that accumulates at the surface of the flange. Once the flanges are removed, the coke is removed from the drum by drilling a pilot hole from top to bottom of the coke bed using high pressure water jets. Following this, the main body of coke left in the coke drum is cut into fragments which fall out the bottom and into a collection bin, such as a bin on a rail cart, etc. The coke is then dewatered, crushed and sent to coke storage or a loading facility.

2. Vibration Monitoring Device

Although the present invention is intended to cover the use of vibration monitoring systems throughout delayed coker unit system, or rather the devices of the present invention may be utilized to monitor vibration at any point in the delayed coker unit operation, one ordinarily skilled in the art will recognize that the invention as explained and described herein may also be designed and used in other environments where monitoring vibration may provide useful data regarding mechanical operations.

Other embodiments relates to the system, which utilize acoustical monitoring systems to receiving useful information regarding the decoking operation. Other embodiments relate to systems, which utilize temperature monitoring systems to receiving useful information regarding the decoking operations. Other embodiments relate to systems which utilize pressure monitoring systems to receive useful information regarding the decoking operation. The remainder of this discussion focuses primarily on the use of vibration monitoring systems as an exemplary embodiment of the present invention. Accordingly, the description as follows is equally relevant to the use of acoustical, temperature, pressure, monitoring system. It is contemplated that the use of acoustical, temperature and pressure monitoring systems could be used to replace the vibration monitoring systems as described herein. Accordingly, the following discussion is not limited to vibration monitoring systems, rather, vibration monitoring systems are a nonlimiting example of a preferred embodiment of the present invention.

The present invention describes a vibration monitoring system for monitoring the vibration at any point in the delayed coker unit operation. In a non limiting example, some embodiments relate to continuous monitoring and detection of reduced material thickness in elbows and pipes which are carrying high temperature and/or high pressure fluids or gases.

In other embodiments the monitoring system may be utilized to measure bearing wear. In a preferred embodiment bearing deterioration can be detected before failure on critical rotating machinery either not being monitored or being periodically monitored.

In other embodiments the monitoring system may be used for detecting coke clogging the furnace pipes which are heating the petroleum before going into the coke drum.

In other embodiments the monitoring system may be used to monitor/detect the movement of fluids/gas in pipes.

In some embodiments vibration may be monitored in a delayed coker unit operation at the drill stem, on a drum, on a fluid pipe, on a fluid pump or at any other point in the delayed coker unit operation. Vibration may be monitored at any one point, or more than one point in one or more directional axes.

As the present invention is especially adapted to be used in the coking process, the following discussion will relate specifically in this manufacturing area. It is foreseeable however; that the present invention may be adapted to be an integral part of other manufacturing processes producing various elements or by-products other than coke, and such processes should thus be considered within the scope of this application. The present invention will now be described with reference to the drawings, wherein like reference numerals are used to refer to like elements throughout.

Referring initially to FIG. 1, which illustrates a depiction of an embodiment of a refinery operation 2. FIG. 1 depicts a pair of coke drums 6. Additionally depicted is a drill stem 8 connected to a cutting head 14, wherein the depicted cutting head 14 comprises nozzles for boring 12 and nozzles for cutting 10.

In some embodiments, a vibration monitoring device is placed on drill stem 8 and/or on coke drum 4, 6. In some embodiments, the vibration monitoring device attached to elements of the delayed coker unit are preferably accelerometers 16, which may be utilized to measure vibration in one or more axes. In preferred embodiments of the present invention, the accelerometer 16 measures vibration in one axes. For example, an accelerometer 16 may be utilized to measure vibration in a horizontal axes and/or a vertical axes. In other embodiments the multiple accelerometers may be used to measure vibration in two or more axes. In a non-limiting example, one accelerometer 16 may be utilized to measure vibration in a horizontal axes and another accelerometer may be utilized to measure vibration in a vertical axes.

In some embodiments the accelerometers 16 may be attached to elements of the delayed coker unit operation in various orientations. For example, an accelerometer 16 may be attached to the drill stem 8 in a radial axis, in a rotational axes, a longitudinal axes, a horizontal axes or a vertical axes. Accordingly, the data acquired from an accelerometer 16 will depend upon the placement and the orientation of the accelerometer 16.

Figure 2A:
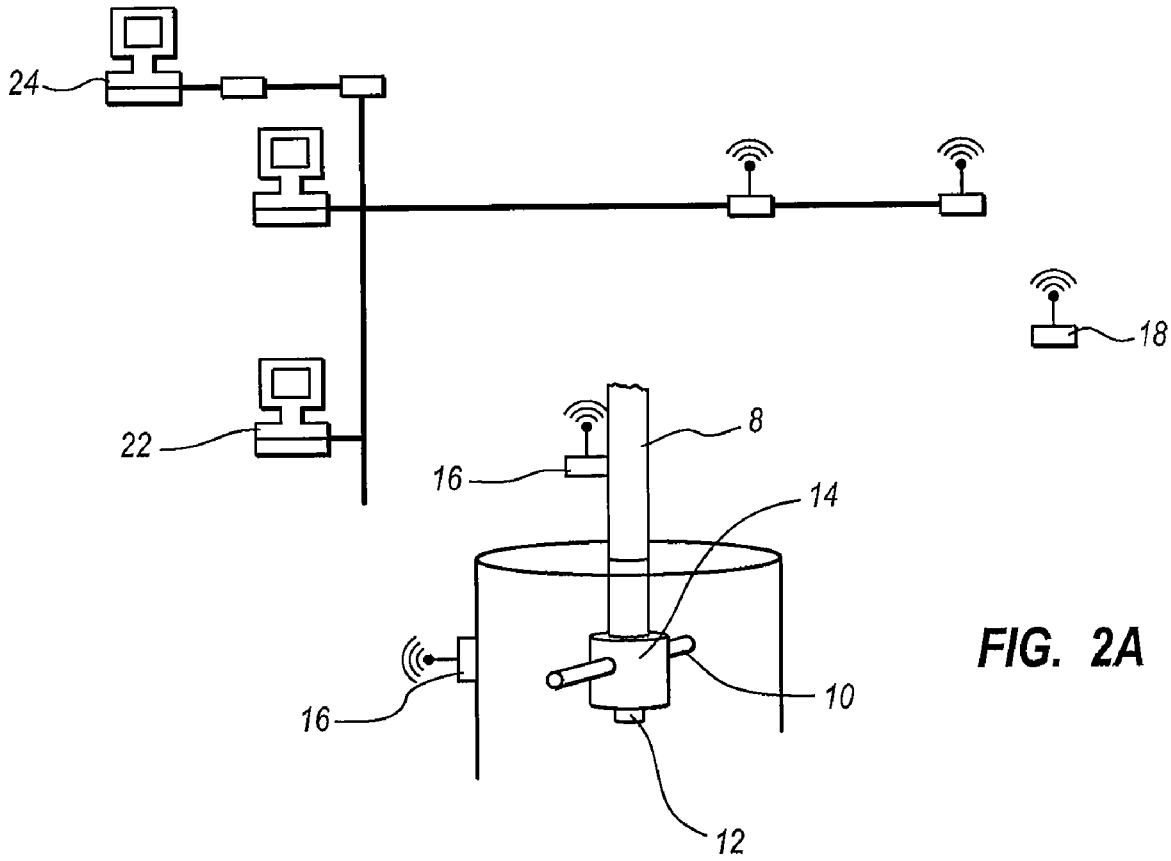
FIG. 2 illustrate, alternative embodiments of the operational layout utilized to assess the status of the cutting tool during decoking operation.
Figure 2B:
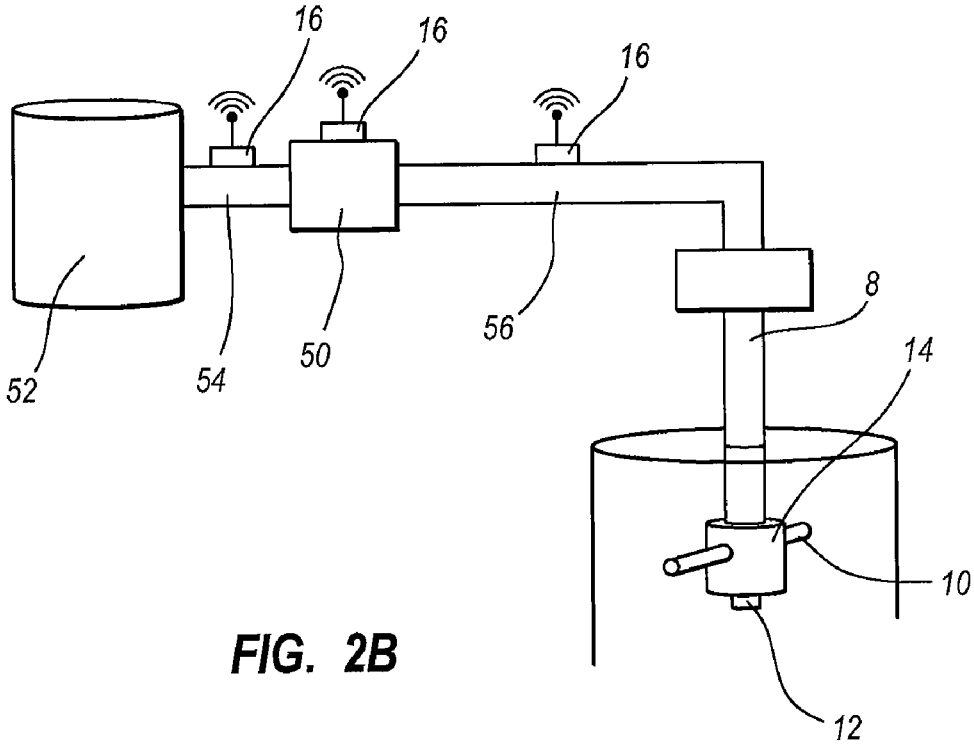

FIGS. 2A and 2B illustrate embodiments of an operational layout of preferred embodiments of the present invention. The vibration monitoring system of the present invention collects data from one or more positions in the delayed coker unit operation. In some embodiments vibration monitoring systems may comprise the ability to collect vibration data from one point in the delayed coker unit operation or from several points in the delayed coker unit operation. In a non-limiting example, the system may comprise an accelerometer for measuring vibrations at one or more positions in a delayed coker operation. In a non-limiting example, accelerometer 16 may be attached in the delayed coker unit operation to the water pump 50, a first fluid line 54, a fluid reservoir 52, a second fluid line 56, the drill stem 8, and/or a coke drum 4, 6.

Some embodiments may comprise accelerometers 16, active repeaters 18, network access points 20, local computer systems 22 and/or remote computer systems 24. In some embodiments the vibration monitoring system comprises an accelerometer 16, coupled to the drill stem 8, wherein the accelerometer 16 measures vibration associated with the operational status of the cutting tool (e.g., cutting or boring) in a given coke drum 4, 6. When the drill is in boring mode and water is being ejected from high pressure nozzles 12, to cut a bore hole through the solid coke resident in the off line coke drum 4, the accelerometer 6 will measure vibrations that are produced as a result of the boring process. The data received by the accelerometer 16 during the boring process may be transmitted wirelessly to active repeaters or directly to a network access point. The wireless repeaters may be utilized to relay data to network access points 20, if such access points 20 are remotely located from the accelerometer 16 itself.

Once received at access points, the data produced by the accelerometer 16, is transmitted to a computer system. The computer system may be on-sight 22 or off-sight 24, or a combination of both. The data may be stored in a data base. The data may be exported to a Fast Fourier Transform ("FFT"). The calibrated and transformed data is utilized to create a FFT fingerprint. Accordingly, as the drill stem is in a boring mode, data created by the vibrational nature of boring is translated into a FFT fingerprint, which coincides with the boring process for a given coke drum.

It is contemplated by the present invention that each coke drum may have a unique fingerprint. Accordingly, the present invention contemplates a utilizing software which is capable of identifying the unique fingerprint of a given coke drum, and which is capable of producing modified data (e.g., FFT fingerprint) which would allow an operator to readily ascertain that the cutting tool was presently boring.

Some embodiments may comprise accelerometers 16 and computer systems. Accordingly, in some embodiments of the present invention, the vibration monitoring system comprises at least a single accelerometer 16, coupled to at least one position in the delayed coker unit operation, wherein the accelerometer 16 measures vibration associated with the operational status of the cutting tool (e.g., cutting or boring) in a given coke drum for and/or 6. In a non-limiting example, the accelerometer 16 may be attached a first pipe 54 which delivers fluid from the fluid reservoir 52 to the fluid pump 50. In another non-limited example, one or more accelerometers 16 may be attached to the fluid pump 54. In another non-limited example, one or more accelerometers 16 may be attached to a second pipe 56, which allows fluid to move from the fluid pump 50 to the drill stem 8. In another non-limiting example, one or more accelerometers may be coupled to a coke drum 4, 6.

In other embodiments, multiple accelerometers 16 may be used at a single location in a delayed coker unit operation to measure vibration in multiple axes.

The accelerometers 16 placed at one or more of the various mentioned and unmentioned locations in a delayed coker operation may be utilized to measure vibrations that are produced as a result of a boring, cutting and/or ramping between boring and cutting processes in a coker drum. The data generated by the accelerometer during the boring, cutting, and/or ramping processes may be transmitted wirelessly or hard-wired to computer systems 24.

When the drill has successfully completed going through the solid coke in the coke drum and a bore hole has been created, an operator switches the flow of water from the boring nozzles to the cutting nozzles. In semi-automated and automatic systems, the drill head remains in the coke drum and is not visible to the operator. Accordingly, without a means of monitoring the status of the drill head, whether it is in boring, cutting or ramping mode, the operator cannot be certain that the drill head has successfully switched from boring mode to cutting mode. In some embodiments of the invention, the accelerometer 16 attached to a portion of the coking apparatus measures the vibration changes as the drill is switched from boring to cutting.

The process of switching from boring to cutting, or cutting to boring is designated herein as ramping. In a non-limiting example, one or more accelerometers 16 placed at one or more of the above-mentioned locations in a delayed coker unit operation collect data during the delayed coker unit operation. The data collected by the accelerometers(s) 16 and processed by a computer may create a "birth certificate" or signature frequency fingerprint for a particular coke drum. Once a birth certificate fingerprint has been determined or established, normal operation of the decoking process may be monitored remotely. As the "run mode" signature is received into a computer system from the delayed coker operation, this run mode signature may be compared to the birth certificate signature to determine the operational mode of the delayed coker operation. In a non-limiting example, the run mode signature of a cutting tool in a cutting mode would produce a run mode signature that when compared with the birth certificate, the fingerprint would allow an operator at a remote location to reliably and repeatedly identify that the cutting tool was in a cutting mode. Accordingly, for a give coke drum, the computer system collects and assembles data, allowing the computer system and/or operator to recognize by the data being received from one or more accelerometer, whether a delayed coker unit is cutting, boring and/or ramping.

In some embodiments, the accelerometer 16 receives data relating to the vibration associated with a particular cutting tool which is in the cutting mode, the amplitude and frequency of the vibration is measured by the accelerometer 16 in one or more axis and such data is transmitted through the above described system to a central processing unit where the data is converted by the FFT into an FFT fingerprint which correlates with the cutting mode of a particular cutting tool. In other embodiments, in addition to the use of FFT, averaging and correlating biorhythms are also used. Accordingly, for any delayed coker unit operation the software of the present invention will receive data from an accelerometer associated with boring, cutting or ramping and will identify FFT fingerprints which correspond to the boring the cutting and/or ramping modes of a particular drill.

In some embodiments the vibration data or the FFT fingerprint associated with boring and cutting may be translated into a simple indicator light system. For example, the system contemplates illuminating a light of a particular color (e.g., a green light) when the drill is in the boring mode and illuminating a different indicator light (e.g., a red light) when the drill is in cutting mode. This simplified indicator light system may be used to prevent user error by making it very easy for any operator to quickly assess whether the drill is in boring or cutting mode.

The present invention contemplates coupling the accelerometer to at least one position into the delayed coker unit operation. The present invention contemplates coupling the accelerometer by various means. In some embodiments of the present invention, the accelerometer may be coupled to a portion of the delayed coker unit operation by magnetic coupling. In other embodiments, the accelerometer may be bolted to the apparatus to be measured. In other embodiments the accelerometer may be placed in a "saddle" and strapped to the apparatus for which vibration is to be measured. In a non-limiting example, an accelerometer may be placed in a "saddle" and strapped with stainless steel straps to the top of the drill stem, securing the accelerometer to the drill stem in a desired orientation and in a fashion that preserves the integrity of the data acquiring process by ensuring consistent positioning and contact with the drill stem.

Figure 3:
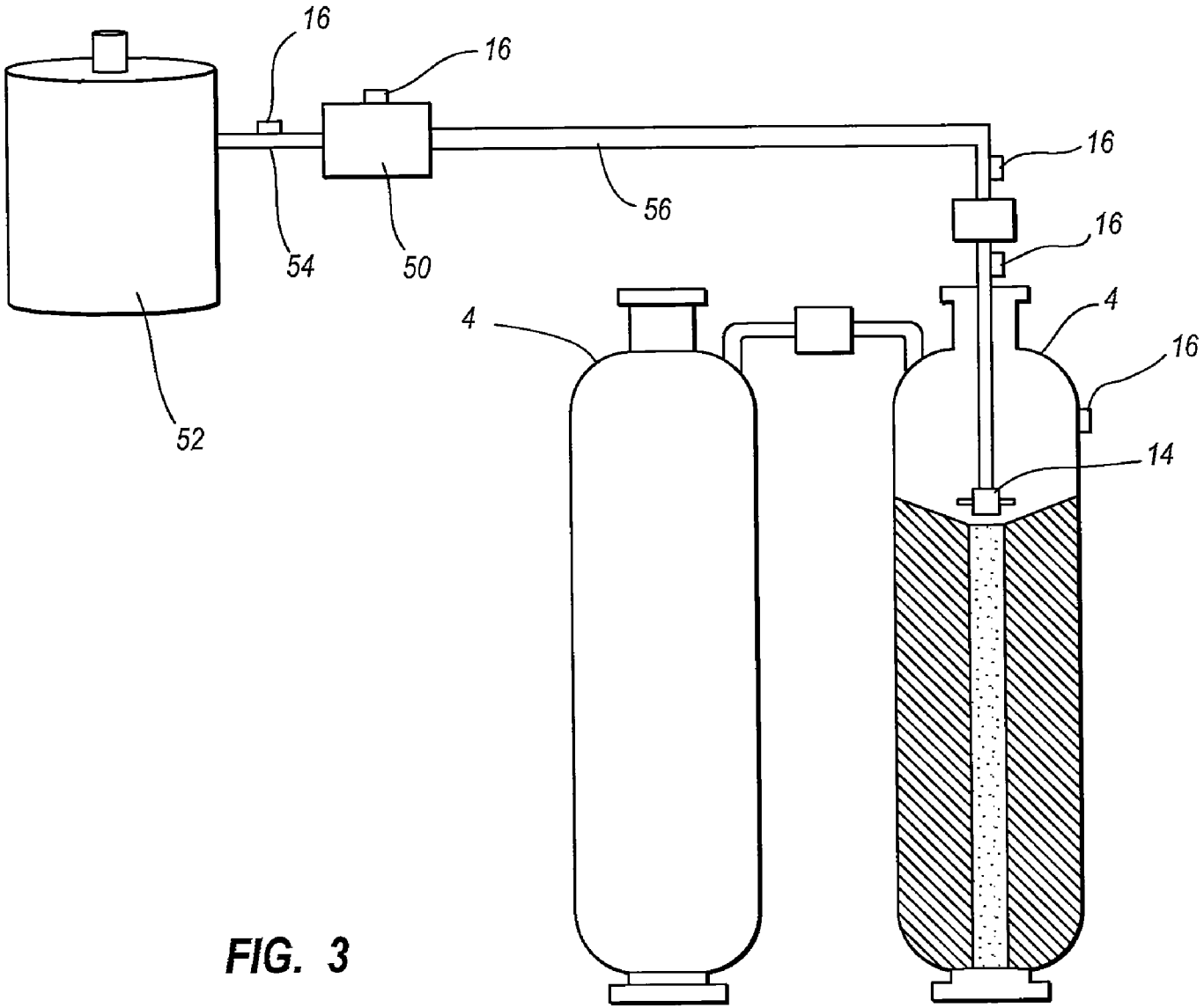
FIG. 3 illustrates, an embodiment of a coke drum with a partially lowered drill stem.

FIG. 3 illustrates a on-line coke drum 6 and an off-line coke drum 4, wherein the off-line coke drum has a drill stem 8 in a partially lowered position. The cutting tool 14 of FIG. 3 is depicted as ejecting fluid in a horizontal direction from the drill head. Accordingly, the drill head depicted in FIG. 3 is in a cutting mode. FIG. 3 additionally depicts the bore hole which has already been cut through the coke which allows debris to fall through to a chute below the coke drum. Additionally, FIG. 3 illustrates the possible position of an accelerometer 16 as being coupled to the drill stem the outside of the coke drum. A first pipe 54, the water reservoir 52, a second pipe 56 and/or to the water pump 50. The invention additionally contemplates attaching one or more accelerometers to other positions in the delayed coker unit operation to measure the vibrational output of the cutting and boring modes of the drill. In some embodiments of the present invention accelerometers 16 are redundantly placed and utilized in more than one position on a drill stem. Thus, in some embodiments invention multiple accelerometers 16 may be attached to one drill stem to redundantly feed data to the computer operating systems of the present invention for analysis.

In other embodiments, multiple accelerometers 16 may be attached to the first pipe 54, which conducts fluid from the fluid reservoir 52 to fluid pump 50, to redundantly feed data to a computer operating system for analysis. In other embodiments, multiple accelerometers 16 may be attached to a second pipe 56 to redundantly feed data to computer operating system for analysis. In other embodiments, multiple accelerometers 16 may be attached at any various locations in the delayed coker unit operation to feed data to a computer operating system.

Figure 4:
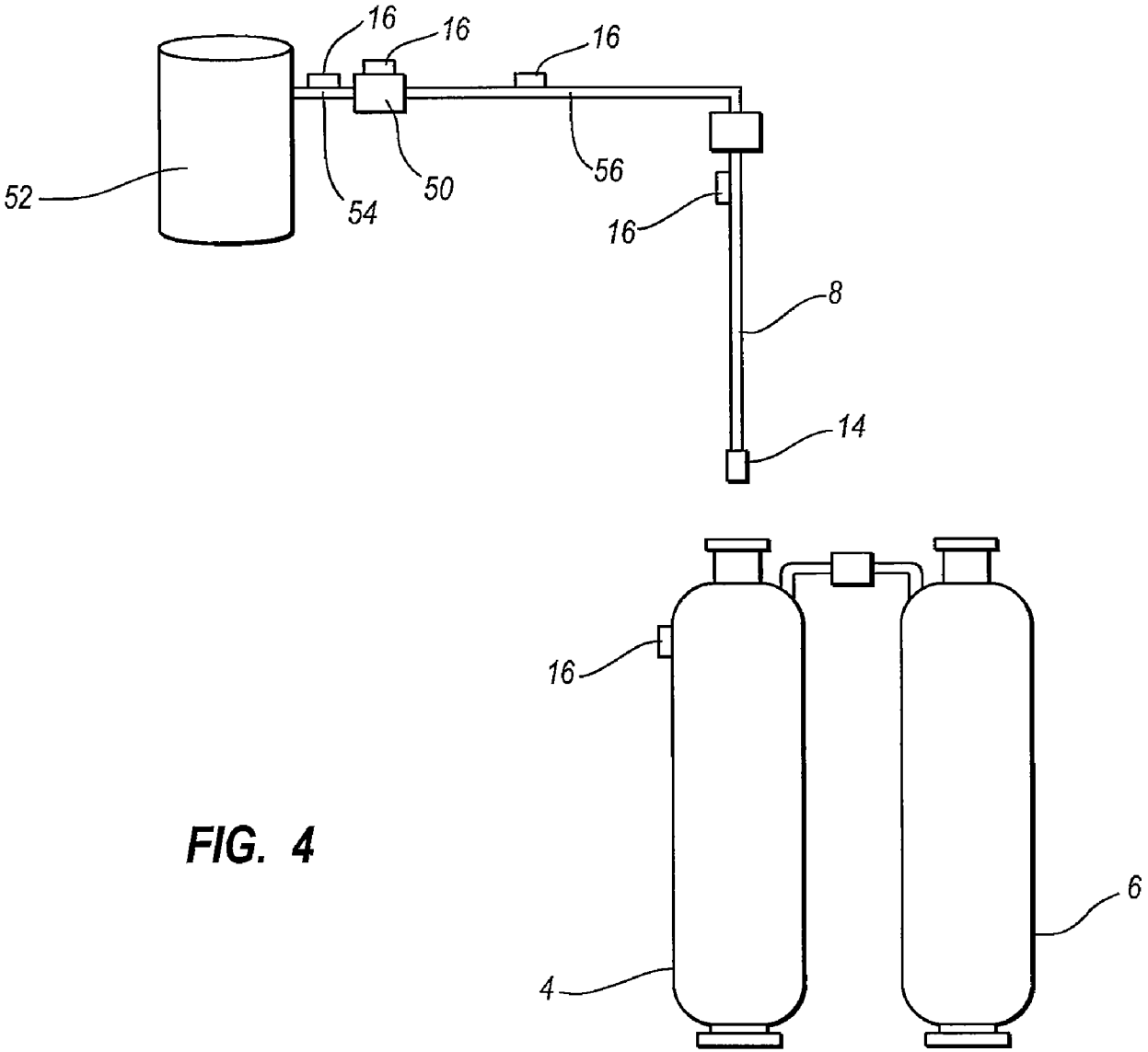
FIG. 4 illustrates, an embodiment of a coke drum with a fully raised drill stem.

FIG. 4 illustrates a drill stem in a fully raised position. In some embodiments of the present invention, the accelerometer may be attached as indicated in FIG. 4 as being on top of the drill stem 8. Alternatively, one ore more accelerometers 16 may be placed on a coke drum 4, 6, a fluid reservoir 52, a first pipe 54, a fluid pump 50 and/or a second fluid pipe 56 to measure the vibrational status of a coke drum (e.g., cutting, boring or ramping mode). Alternatively, one or more accelerometers 16 may be placed at more than one location throughout the delayed coker unit operation.

In some embodiments the accelerometer 16 may further comprise an electric sensor, a temperature sensor, a digital signal processor, data memory, wireless transceiver, internal battery and an internal antenna. In some embodiments, the accelerometer 16 may be preferably powered with an internal lithium battery wherein the solid state accelerometer 16 collects and transmits vibration data securely by a wireless link. The data collection parameters may be configured from a network windows computer. In some embodiments invention the accelerometer 16 is completely wireless. In other embodiments the accelerometer 16 is hardwired to a computer system.

In some embodiments of the present invention the accelerometer 16 is vibration and temperature sensing. In some embodiments of the invention the accelerometer 16 measures or has a 0.5 Hz to 10 kHz frequency response with 1 Hz to 40 kHz sampling speed. In other embodiments of the invention, the accelerometers 16 measures or has a frequency response below 0.5 Hz 1 In other embodiments, the accelerometer measures or has a frequency response above 10 kHz. In non-limiting examples the accelerometer 16 has a frequency response at 0.01, 0.1, 0.2, 0.3, 0.4, 0.5, 1, 2, 3, 4, 5, 6, 7, 8, 9, 10, 11, 12, 13, 14, 15, 20, 30, 50, 60, 70, 80, 90 and/or 100 kHz frequency response. In other embodiments, the accelerometer has a sampling speed of less than 1 Hz. In other embodiments, the accelerometer has a sampling speed of more than 40 kHz. Accordingly, in a non-limiting example the accelerometer has a sampling speed of 0.5 Hz, 1 Hz, 10 Hz, 20 Hz, 30 Hz, 40 Hz, 50 Hz, 60 Hz, 70 Hz, 80 Hz, 90 Hz, 1 kHz, 10 kHz, 20 kHz, 30 kHz, 40 kHz, 60 kHz, 80 kHz, 100 kHz, and/or more than 100 kHz.

In some embodiments the accelerometer 16 is software selectable 5 g to 50 g maximum range. In some embodiments the accelerometer 16 is software selectable to less than 5 g and or more than 50 g. Accordingly, in a non-limiting example, the accelerometer software is selectable to 1 g, 10 g, 20 g, 30 g, 40 g, 50 g, 60 g, 70 g, 80 g, 90 g, 100, and/or more than 100 g. In some embodiments the accelerometer 16 produces time trace, FFT and overall data formats and may transmit data up to 250 feet. In some embodiments, the accelerometer produces time trace, FFT and overall data formats and may transmit data more than 250 feet. Accordingly, in some embodiments, the accelerometer may transmit data 300 ft, 400 ft, 500 ft, 600 ft, 700 ft, 800 ft, 900 ft, 1000 ft, 2000 ft, 3000 ft, 4000 ft, 5000 ft, 10000 ft and/or more than 10000 ft. In some embodiment the accelerometer 16 has an easy to replace battery with a life span that lasts for more than two (2) years.

In some embodiments, the active repeater 18 of the invention may be utilize an embodiment of the invention when sensors are out of range of the network access points 20. This can occur if sensor is greater than 250 feet from the network access point 20 or if an object is shielding the signal emitted from the accelerometer. The active repeaters utilized in some embodiments may have the benefit of being completely wireless, easy to install, have a range of up to 250 feet, have easy to replace batteries and transmit encrypted air corrected wireless data utilizing solid state (i.e. no moving parts).

In some embodiments of the invention the network access point 20 of the present invention bridges the gap between the wireless sensor network and the central processing units 22, 24, of the present invention. Thousands of accelerometers may share the same wireless network hosted by one or more network access points. The network access point of the invention has the benefits of allowing multiple accelerometers to send data to the central processing units. In some embodiments the network accessing point stores data records in an off-line mode and encrypts error corrected wireless transmissions or utilizes error corrected wirelessly transmitted data from the data collectors, namely the accelerometers of the present invention. The network access point in some embodiments communicates with the central processing units of the present invention utilizing either wireless connections or internet connections.

Figure 5:
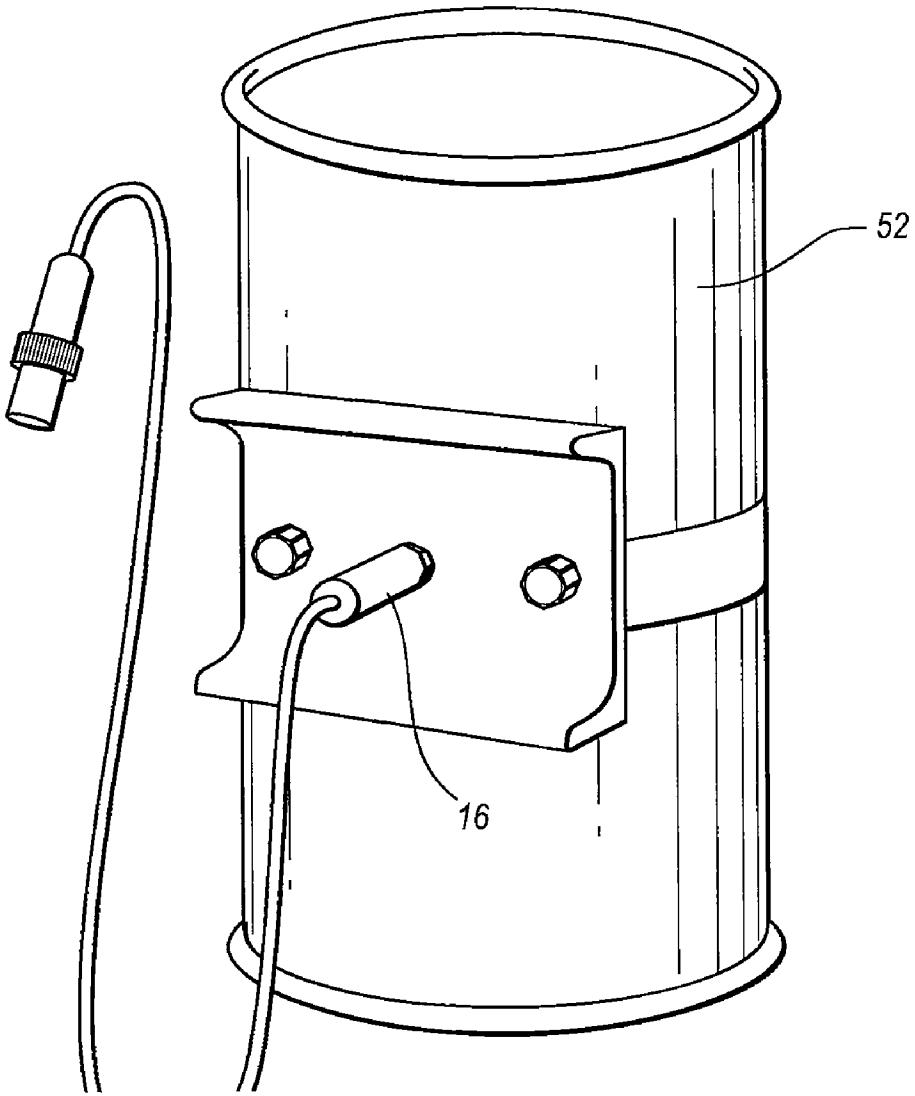
FIG. 5 illustrates an embodiment of the placement of multiple accelerometers on a stationary pipe which supplies water to a drill.

FIG. 5 depicts two accelerometers 16 positioned on a water pipe or fluid pipe 54 and/or 56. As depicted in FIG. 5, more then one accelerometer 16 may be utilized to measure vibrational data at any given point in the operation. As depicted in FIG. 5 the accelerometers 16 are hardwired to a computer operating system to transmit data generated by the accelerometer 16 directly to a computer for analysis. As depicted in FIG. 5 various accelerometers 16 may be oriented in different axes to acquire multiple data single sets in order to confirm the operational status of a cutting tool in a delayed coker operation. In a non-limiting example, and as depicted in FIG. 5, one accelerometer 16 may be placed to measure vibration in a horizontal axis while another accelerometer 16 may be placed to measure vibration in a vertical axis. Accelerometers 16 as depicted in FIG. 5 may be positioned likewise throughout the delayed coker unit operation.

Figure 6:
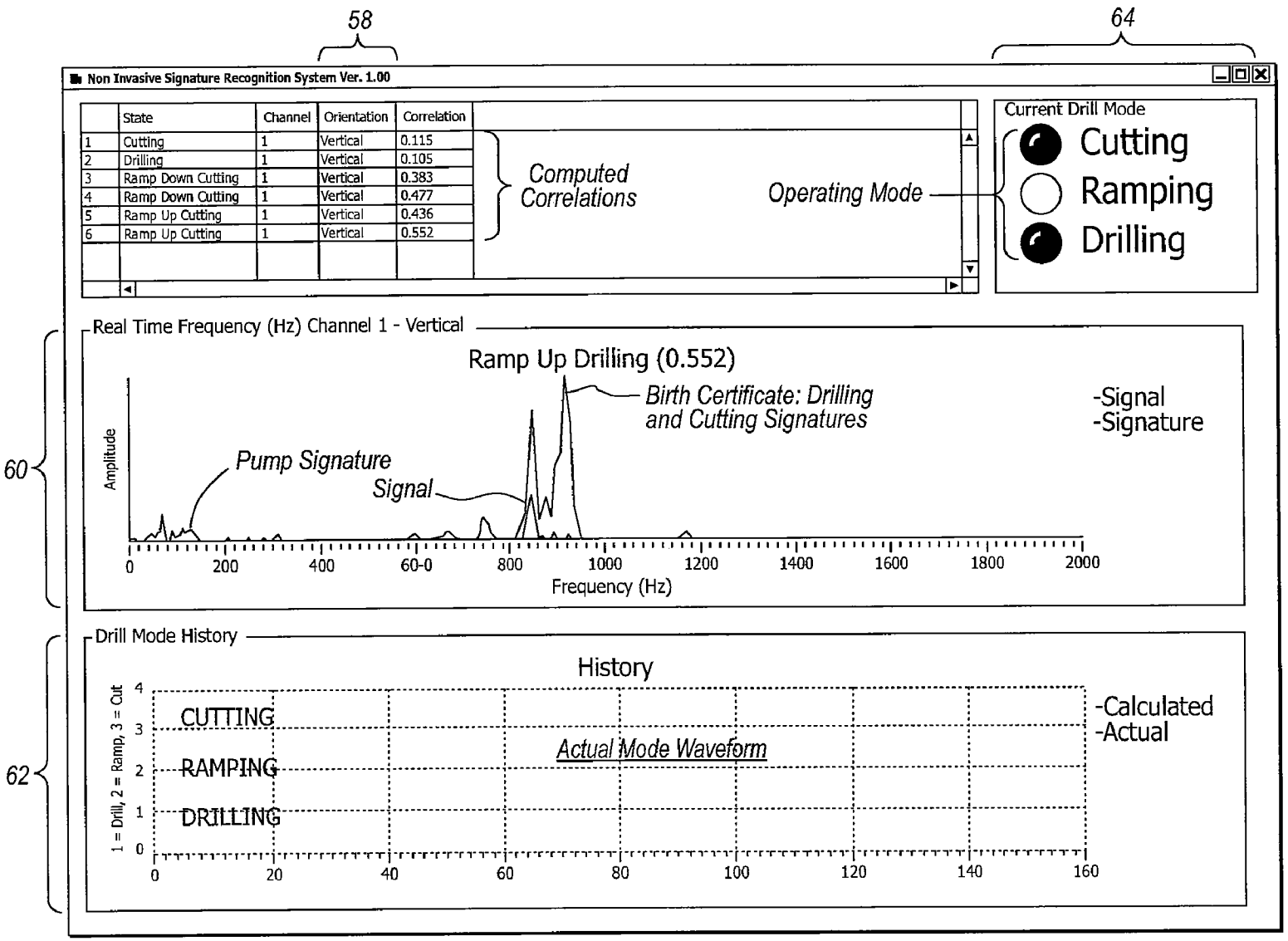
FIG. 6 illustrates an embodiment of a display containing real time frequencies and wave forms associated with cutting, boring, and drilling in a decoking operation.

FIG. 6 depicts a display screen, which may be visualized on a computer monitor and utilized by an operator, technician or engineer to monitor and/or analyze whether a cutting tool is cutting, drilling, or ramping during delayed coker unit operation. As depicted, the computer may indicate what mode, ramping, cutting, or drilling, the drill is in at a current time and may indicate the orientation axes from which the data is being received. As depicted in FIG. 6 the orientation axes being measure in a non-limiting example is vertical 58.

Additionally, data related to the real time frequency in Hertz for a particular accelerometer 16 may be displayed 60. The real time frequency may be utilized to analyze the frequency associated with drilling, cutting, ramping, or other processes in delayed coker unit operations including the vibration associated with the water pump 50.

Additionally, as depicted in FIG. 6 the drill mode history 62 may be displayed allowing an operator or other person to analyze the history of drilling, ramping, or cutting that has occurred over a period of minutes, hours, days, weeks, years or longer.

In addition to the data illustrated by FIG. 6, the present invention contemplates allowing users to access and productively use and modify other data sets. As depicted in FIG. 6 a display may also contain a simple indicator light 64 which would allow an operator to determine whether a current drill mode, including whether the drill is cutting, ramping, or drilling.

What is claimed:

1. A device for monitoring a cutting tool in a delayed coker unit operation, comprising:

a vibration sensor structured to detect when the cutting tool is switched between boring mode and cutting mode;

an output signal from said vibration sensor; and a computer system comprising software resident on said computer system structured to receive said output signal and convert the output signal into a usable wave form.

2. The device of claim 1, wherein said detection is accomplished without raising the cutting tool out of a coke drum for mechanical alteration or inspection.

3. The device of claim 1, further comprising a visual display structured to display what mode the cutting tool is in.

4. The device of claim 1, further comprising vibrational data, which is utilized to provide information regarding a mechanical status of the cutting tool.

5. The device of claim 1, wherein said vibration sensor comprises an accelerometer.

6. The device of claim 5, further comprising an additional accelerometer.

7. The device of claim 1, further comprising a wireless relay device structured to communicate data between said vibration sensor and said computer system.

8. The device of claim 1, wherein said vibration sensor is hardwired to said computer system.

9. The device of claim 1, wherein said output signal is routed to a fast fourier transform.

10. The device of claim 9, wherein said output signal is converted into a fast fourier transform fingerprint which may be utilized as a signature associated with a mechanical status of the cutting tool.

11. The device of claim 10, wherein said mechanical status is said boring mode.

12. The device of claim 10, wherein said mechanical status is said cutting mode.

13. The device of claim 1, further comprising:

an accelerometer wherein the accelerometer provides an output signal;

at least one network access point structured to receive the output signal from the accelerometer;

software resident on said computer system for converting the output signal into a useful wave form; and a display apparatus structured to provide information about a status of the cutting tool.

14. A vibration monitoring device, comprising:

a housing;

a transducer coupled at a position in a delayed coker unit operation, the transducer providing an output signal representative of an operational status of a cutting tool;

a fourier transform, structured to modify the output signal;

a display structured to indicate the operational status of the cutting tool; and a computer system comprising software resident on said computer system structured to receive said output signal and convert the output signal into a usable wave form.

15. A system for determining a fast fourier transform wave pattern associated with cutting, boring and ramping modes of a cutting tool inside a coke drum comprising:

a vibration sensor structured to generate data;

an output signal from said vibration sensor;

a central processing unit comprising software resident on said central processing unit structured to receive said output signal and convert the output signal into a usable wave form and, a central processing unit structured to identify whether the cutting tool is boring or cutting; and a display operatively connected to said central processing unit.

16. A method of determining status of a cutting tool in a delayed coker operation, comprising:

mounting a transducer to a position in a delayed coker unit operation to provide an output signal related to an operational status of the cutting tool;

routing said output signal to at least one network access point;

transmitting said output signal from said at least one access point to a computer system, wherein software resident on said computer system converts the output signal into a useful wave form;

determining whether the cutting tool is cutting or boring; and displaying the status of the cutting tool in a coke drum.

17. The method of claim 16, wherein said determining is accomplished without raising the cutting tool out of a coke drum for mechanical alteration or inspection.

18. The method of claim 16, further comprising transmitting the output signal from said transducer to a wireless relay device; and communicating data between said wireless relay device to a computer system.

19. The method of claim 16, wherein said determining further comprises the steps of receiving data from a vibration monitor; and converting the data into a usable wave form.

20. The method of claim 19, wherein said converting comprises transforming said data into a fast fourier transform fingerprint, which may be utilized as a signature associated with the operational status of the cutting tool.

21. A device for monitoring a cutting tool in a delayed coker unit operation, comprising:

a vibration sensor structured to detect when the cutting tool is switched between boring mode and cutting mode comprising an accelerometer wherein the accelerometer provides an output signal;

at least one network access point structured to receive the output signal from the accelerometer;

a computer system comprising software resident on said computer system for converting the output signal into a useful wave form; and a display apparatus structured to provide information about a status of the cutting tool.

22. The device of claim 21, wherein the display is structured to display what mode the cutting tool is in.

23. The device of claim 21, further comprising vibrational data, which is utilized to provide information regarding a mechanical status of the cutting tool.

24. The device of claim 21, further comprising a wireless relay device structured to communicate data between said vibration sensor and said computer system.

25. The device of claim 21, wherein said vibration sensor is hardwired to said computer system.

26. The device of claim 21, wherein said output signal is routed to a fast fourier transform.

27. The device of claim 26, wherein said output signal is converted into a fast fourier transform fingerprint which may be utilized as a signature associated with a mechanical status of the cutting tool.

28. The device of claim 27, wherein said mechanical status is said boring mode.

29. The device of claim 27, wherein said mechanical status is said cutting mode.

30. A device for monitoring a cutting tool in a delayed coker unit operation, comprising:

a vibration sensor structured to detect when the cutting tool is switched between boring mode and cutting mode;

an output signal from said vibration sensor; and a computer system comprising software structured to convert the output signal into a signature associated with a mechanical status of the cutting tool.

31. The device of claim 30, further comprising a visual display structured to display what mode the cutting tool is in.

32. The device of claim 30, wherein said vibration sensor comprises an accelerometer.

33. The device of claim 30, further comprising a wireless relay device structured to communicate data between said vibration sensor and said computer system.

34. The device of claim 30, wherein said vibration sensor is hardwired to said computer system.

35. The device of claim 30, wherein said mechanical status is said boring mode.

36. The device of claim 30, wherein said mechanical status is said cutting mode.

37. The device of claim 30, further comprising:

an accelerometer wherein the accelerometer provides an output signal;

at least one network access point structured to receive the output signal from the accelerometer;

software resident on said computer system for converting the output signal into a useful wave form; and a display apparatus structured to provide information about a status of the cutting tool.

38. A device for monitoring a delayed coker unit operation, comprising:

a vibration sensor structured;

an output signal from said vibration sensor; and a computer system comprising software structured to convert the output signal into a signature associated with a mechanical status of the cutting tool.

39. The device of claim 38, further comprising a visual display structured to display what mode the cutting tool is in.

40. The device of claim 38, further comprising vibrational data, which is utilized to provide information regarding a mechanical status of the cutting tool.

41. The device of claim 38, wherein said vibration sensor is an accelerometer.

42. The device of claim 38, further comprising a wireless relay device structured to communicate data between said vibration sensor and said computer system.

43. The device of claim 38, wherein said vibration sensor is hardwired to said computer system.

44. The device of claim 43, wherein said output signal is routed to a fast fourier transform.

45. The device of claim 44, wherein said output signal is converted into a fast fourier transform fingerprint which may be utilized as a signature associated with a mechanical status of the cutting tool.

46. The device of claim 44, wherein said mechanical status is one of said boring mode, said cutting mode, material thickness in a pipe, bearing wear, mechanical deterioration, coke clogging, movement of fluids in pipes and movement of gas in pipes.

47. The device of claim 38, further comprising:

an accelerometer wherein the accelerometer provides an output signal;

at least one network access point structured to receive the output signal from the accelerometer;

software resident on said computer system for converting the output signal into a useful wave form; and a display apparatus structured to provide information about a status of the cutting tool.

* * * * *